US005984737A

United States Patent [19]

Nagano et al.

[11] Patent Number: 5,984,737

[45] Date of Patent: Nov. 16, 1999

[54] STRUCTURE OF CONNECTOR HOUSING

[75] Inventors: Toru Nagano, Shizuoka-ken; Hiroshi Takeda, Kanagawa-ken, both of Japan

[73] Assignee: Yazaki Corporation, Tokyo, Japan

[21] Appl. No.: 09/048,781

[22] Filed: Mar. 27, 1998

[30] Foreign Application Priority Data

Mar. 28, 1997 [JP] Japan ..... 9-078041

[51] Int. Cl.[6] ..... H01R 13/514

[52] U.S. Cl. ..... 439/752; 439/465

[58] Field of Search ..... 439/752, 751, 439/498, 595, 596, 465–467

[56] References Cited

U.S. PATENT DOCUMENTS

| | | | |
|---|---|---|---|
| 5,669,791 | 9/1997 | Endo et al. | 439/752 |
| 5,692,929 | 12/1997 | Hoffmann | 439/752 |
| 5,697,819 | 12/1997 | Hatagishi | 439/752 |
| 5,730,627 | 3/1998 | Okabe | 439/595 |

FOREIGN PATENT DOCUMENTS

| | | |
|---|---|---|
| 61-218081 | 9/1986 | Japan . |
| 61-232582 | 10/1986 | Japan . |
| 63-102184 | 7/1988 | Japan . |

*Primary Examiner*—Lincoln Donovan
*Attorney, Agent, or Firm*—Finnegan, Henderson, Farabow, Garrett & Dunner, L.L.P.

[57] ABSTRACT

A housing body of a connector housing has a terminal receiving chamber receiving a connector terminal, a first terminal engagement portion engaging with the connector terminal received in the receiving chamber, a mounting portion to which a rear holder is mounted, and a holder engagement portion projecting within an insertion groove formed on the outer surface of the housing body. The rear holder has a second terminal engagement portion further engaging with the connector terminal engaged with the first terminal engagement portion in a state of being mounted to the mounting portion, a convex portion inserted into the insertion groove, and a engageable portion which projects from the convex portion and engages with the holder engagement portion. A mounting state of the rear holder can be securely maintained by engaging the holder engagement portion with the engageable portion within the insertion groove.

15 Claims, 5 Drawing Sheets

STRUCTURE OF CONNECTOR HOUSING

BACKGROUND OF THE INVENTION

The present invention relates to a prevention structure of a connector housing for preventing a rear holder attached to a housing body from floating over the housing body.

FIGS. 1 and 2 show a conventional connector housing 100 disclosed in Japanese Utility Model Unexamined Publication No. 63-102184.

The connector housing 100 is constituted by a housing body 110 substantially formed in a rectangular parallelepiped, a first rear holder 130 connected by the housing body 110 and two first bands 101, and a second rear holder 140 connected by the housing body 110 and two second bands 102.

The housing body 110 has a plurality of terminal receiving chambers 111, a first swingable terminal engagement portion 112, a first mounting portion 113, a second mounting portion 114, and first and second holder engagement portions 115 and 116.

Each of the terminal receiving chambers 111 extends from a front end surface 117 of the housing body 110 to a rear end surface 118, and a connector terminal 104 attached to a lead wire 103 is received in the terminal receiving chamber 111. The corresponding terminal is inserted from an opening portion 119 of the front end surface 117 in each of the terminal receiving chamber 111, and the connector terminal 104 is inserted from an opening portion 120 close to the rear end surface 118 in each of the terminal receiving chambers 111. The first terminal engagement portion 112 engages with the connector terminal 104 received in the terminal receiving chamber 111. Second terminal engagement portions 131 and 141 of first and second rear holders 130 and 140 are respectively inserted into the first and second mounting portions 113 and 114. First and second holder engagement portions 115 and 116 respectively prevent the first and second rear holders 130 and 140 mounted to the first and second mounting portions 113 and 114 from floating.

The first and second rear holders 130 and 140 have a plurality of second terminal engagement portions 131 and 141 further engaging with the connector terminal 104 engaging with the first terminal engagement portion 112, and a holding member 132 holding the second terminal engagement portions 131 and 141 in parallel.

A first holder engagement portion 115 is projected in both corners in a rear portion of a surface 121 of the housing body 110, respectively. The rear end surface of the first holder engagement portion 115 is on an extending line of a rear end surface 118 of the housing body 110, and an engagement groove 115*a* is formed forward from the rear end surface of the holder engagement portion 115. Both end portions 133 of the first holding member 132 are inserted into the engagement groove 115*a* and engaged therewith. In accordance with this engagement, the engagement between the first terminal engagement portion 131 and the connector terminal 104 can be maintained.

A second holder engagement portion 116 is projected in both corners in a rear portion of a back surface 122 of the housing body 110, respectively. The rear end surface of the second holder engagement portion 116 is on an extending line of a rear end surface 118 of the housing body 110, and an engagement groove 116*a* is formed forward from the rear end surface of the holder engagement portion 116. Both end portions 133 of the second holding member 142 are inserted into the engagement groove 116*a* and engaged therewith. In accordance with this engagement, the engagement between the second terminal engagement portion 141 and the connector terminal 104 can be maintained.

However, in the conventional connector housing 100 mentioned above, since the first and second holder engagement portions 115 and 116 of the housing body 110 project from the surface 121 and the back surface 122 of the housing body 110, the both holder engagement portions 115 and 116 are easily broken. When the both holder engagement portions 115 and 116 are broken, both the rear holders 130 and 140 float from the housing body 110, so that a double engagement of the connector terminal 104 by both the rear holders 130 and 140 is not performed.

In the conventional connector housing 100 mentioned above, since the holder engagement portions 115 and 116 for the first and second rear holders 130 and 140 of the housing body 110 project from the surface 121 and the back surface 122 of the housing body 110, the holder engagement portions 115 and 116 for both the rear holders 130 and 140 are broken, so that there is a risk that both the rear holders 130 and 140 float from the housing body 110, and a double engagement of the connector terminal 104 by both the rear holders 130 and 140 is not performed.

SUMMARY OF THE INVENTION

An object of the present invention is to provide a structure of a connector housing in-which a double engagement of a connector terminal by a rear holder can be securely maintained.

In order to achieve the object mentioned above, in accordance with the present invention, there is provided a structure of a connector housing comprising:

a housing body having a terminal receiving chamber in which a connector terminal is received, a first terminal engagement portion engaging with the received terminal and a holder engagement portion; and a rear holder having an engageable portion and a second terminal engagement portion, the engageable portion engaging with the holder engagement portion and preventing the rear holder from floating from the holder body, the second terminal engagement portion engaging with the connector terminal which engages with the first terminal engagement portion as the holder engagement portion and the engageable portion are engaged with each other, wherein the holder engagement portion is disposed inside of a concave portion formed on an outer surface of the housing body, the rear holder has a convex portion inserted into the concave portion, and the engageable portion is disposed within the convex portion, and is positioned within the concave portion in a state of being engaged with the holder engagement portion.

In accordance with the structure mentioned above, the holder engagement portion is disposed in the concave portion formed in the outer surface of the housing body, and the engageable portion engaging with the holder engagement portion is disposed in the convex portion of the rear holder inserted into the concave portion. Accordingly, in a state of engaging the engageable portion with the holder engagement portion, the holder engagement portion, the convex portion and the engageable portion are received within the concave portion of the housing body and is protected.

Accordingly, the holder engagement portion, the convex portion and the engageable portion are prevented from being broken, and the rear holder is securely prevented from floating from the housing body. As a result, a double engagement of the connector terminal by the rear holder can be securely maintained.

DESCRIPTION OF THE PREFERRED EMBODIMENTS

An embodiment in accordance with the present invention will be described below with reference to the attached drawings.

FIGS. 3 to 6 show a structure of a connector housing in accordance with an embodiment of the present invention.

Figure 3:
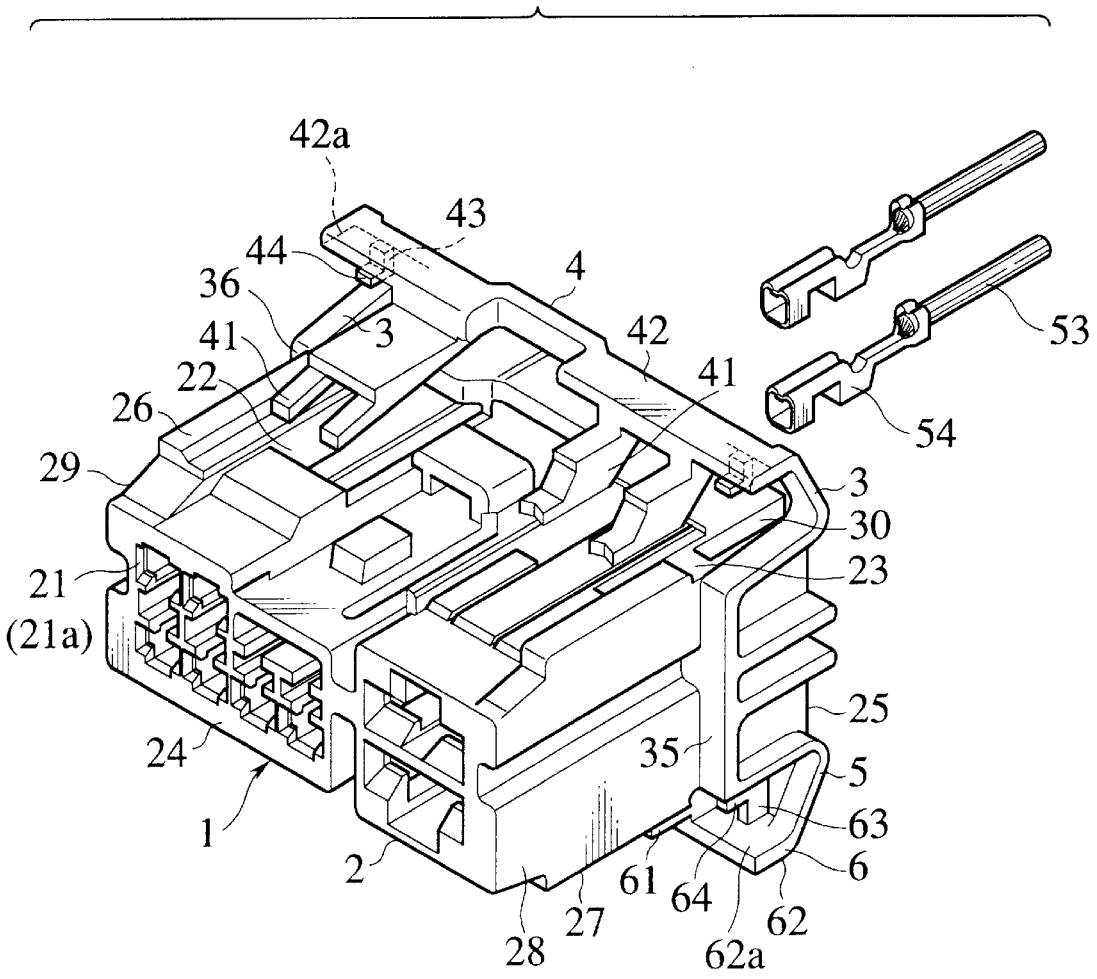
FIG. 3 is a perspective view which shows a structure of a connector housing in accordance with an embodiment of the present invention.
Figure 4:
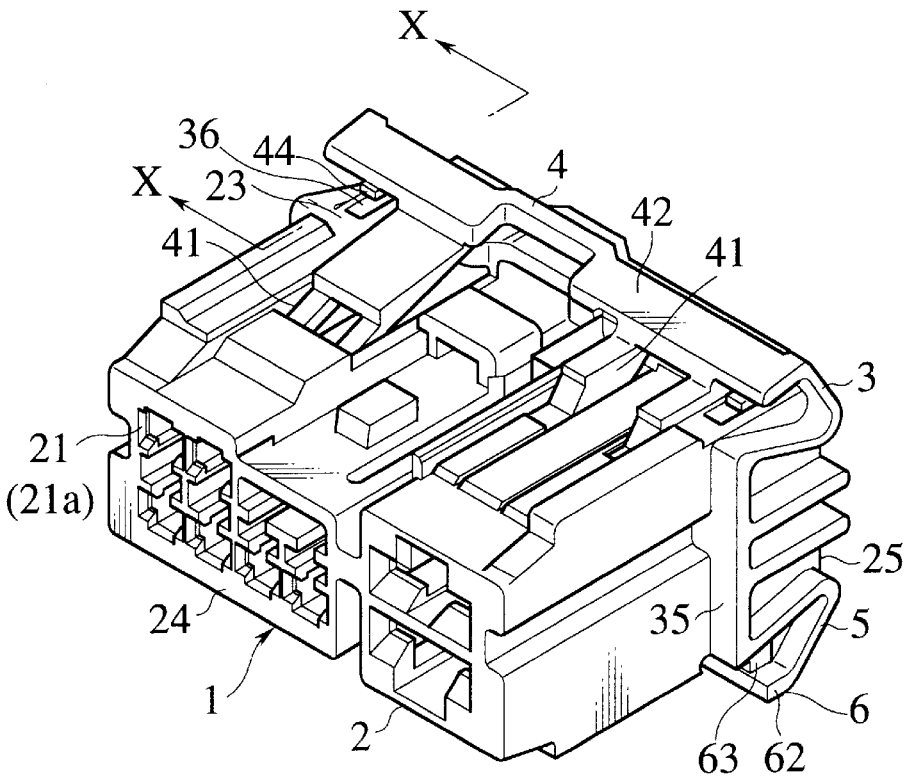
FIG. 4 is a perspective view which shows a state immediately before assembling the connector housing shown in FIG. 3.
Figure 5:
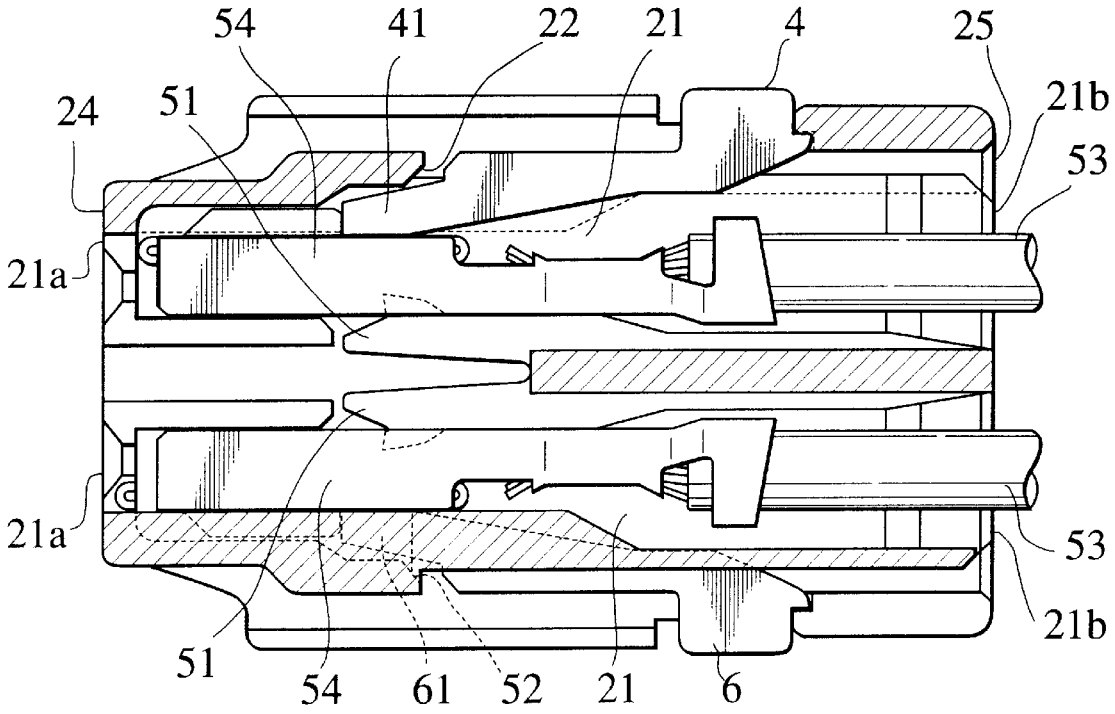
FIG. 5 is a vertical cross sectional view of the connector housing shown in FIG. 3 after assembling.

As shown in FIGS. 3 to 5, a connector housing 1 is constituted by a housing body 2 substantially formed in a rectangular parallelepiped, a first rear holder 4 connected by the housing body 2 and two first bands 3, and a second rear holder 6 connected by the housing body 2 and two second bands 5.

The housing body 2 has a plurality of terminal receiving chambers 21, a first swingable terminal engagement portion 51, a first mounting portion 22, a second mounting portion 52, and first and second holder engagement portions 23. In this case, since the second holder engagement portion is substantially the same structure as that of the first holder engagement portion 23, illustration thereof is omitted.

Three terminal receiving chambers 21 are formed above the housing body 2 and five terminal receiving chambers 21 are formed below the housing body 2 in a parallel manner. Each of the terminal receiving chambers 21 extends from a front end surface 24 of the housing body 21 to a rear end surface 25 substantially in a linear manner. A connector terminal 54 attached to a lead wire 53 is received in the terminal receiving chamber 21. The corresponding terminal is inserted from an opening portion 21*a* of the front end surface 24 in each of the terminal receiving chamber 21, and the connector terminal 54 is inserted from an opening portion 21*b* close to the rear end surface 25 in each of the terminal receiving chambers 21. The first terminal engagement portion 51 engages with the connector terminal 54 received in the terminal receiving chamber 21.

The first mounting portion 22 is disposed in the rear portion of the surface 26 of the housing body 2, and opens the terminal receiving chamber 21. The second mounting portion 52 is disposed in the rear portion of the back surface 27 of the housing body 2 and opens the terminal receiving chamber 21. The first rear holder 4 and the second rear holder 6 are respectively mounted to the first mounting portion 22 and the second mounting portion 52.

The first rear holder 4 has four second terminal engagement portions 41 and holding members 42. The holding member 42 is disposed in the rear end side on the surface 26 of the housing body 2 and extends to a direction substantially perpendicular to the terminal receiving chamber 21. Four second terminal engagement portions 41 are disposed in parallel and projects toward the surface 26 of the housing body 2 from the holding member 42. In a state that the first rear holder 4 is mounted to the first mounting portion 22, the second terminal engagement portion 41 is inserted into the terminal receiving chamber 21 and further engages with the connector terminal 54 engaged with the first terminal engagement portion 51. Accordingly, the connector terminal 54 becomes a state of double engaged. Convex portions 43 are provided in the right and left end portions of the back surface 42*a* of the holding member 42. Each of the convex portions 43 projects toward the surface 26 of the housing body 2.

In the same manner, the second rear holder 6 has six second terminal engagement portions 61 and holding members 62. The holding member 62 is disposed in the rear end side on the back surface 27 of the housing body 2 and extends to a direction substantially perpendicular to the terminal receiving chamber 21. Six second terminal engagement portions 61 are disposed in parallel and projects toward the back surface 27 of the housing body 2 from the holding member 62. In a state that the second rear holder 6 is mounted to the second mounting portion 52, the second terminal engagement portion 61 is inserted into the terminal receiving chamber 21 and further engages with the connector terminal 54 engaged with the first terminal engagement portion 51. Accordingly, the connector terminal 54 becomes a state of double engaged. Convex portions 63 are provided in the right and left end portions of the back surface 62*a* of the holding member 62. Each of the convex portions 63 projects toward the back surface 27 of the housing body 2.

Band holding portions 35 and 36 having substantially the same height as that of the housing body 2 are projected in both the side surfaces 28 and 29 of the housing body 2. The first band portion 3 extends to a position close to the rear end surface 25 from the upper end of the band holding portions 35 and 36, turns to an upper direction of the surface 26, and is connected to the rear end surface in both the right and left ends of the holding member 42. The second band portion 5 extends to a position close to the rear end surface 25 from the upper end of the band holding portions 35 and 36, turns to an upper direction of the back surface 27, and is connected to the rear end surface of both the right and left ends of the holding member 62.

The first and second bands 3 and 5 respectively keep the first and second rear holders 4 and 6 in a predetermined position above the surface 26 and the back surface 27, and is structured such as to be bent at a time when the rear holders 4 and 6 move from a predetermined position so as to bias the rear holders 4 and 6 to the predetermined position.

In both the corners of the rear portion of the surface 26 in the housing body 2, insertion groove 30 corresponding to the concave portions extending to a direction substantially in parallel to the terminal receiving chamber 21 from the rear end surface 25 of the housing body 2 are respectively formed.

Figure 6:
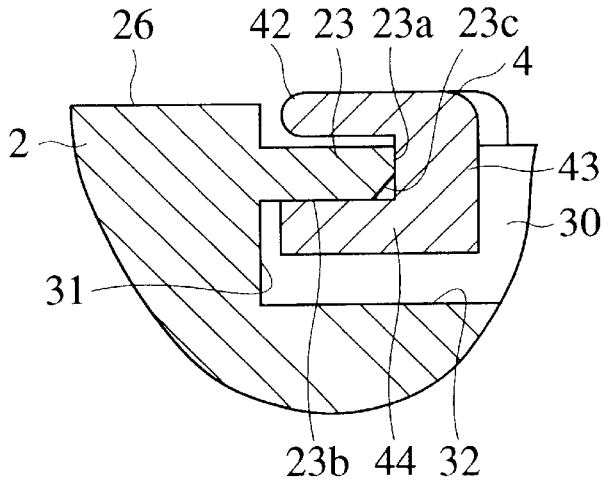
FIG. 6 is an enlarged cross sectional view which shows a part of a cross section along a line X—X of FIG. 4.

As shown in FIG. 6, an insertion groove 30 has a wall surface 31 in the opposite side of the rear end surface 25, and a first holder engagement portion 23 for the first rear holder 4 is projected rearward from the wall surface 31. Further, a portion to be engaged 44 which extends, from an extension surface 45 (refer to FIG. 6), toward the front end surface 24 of the housing body 2 (refer to FIG. 3) is projected in the front end portion of the front surface in each of the convex portions 43 of the first rear holder 4. When the first rear holder 4 is mounted to the first mounting portion 22, the engageable portion 44 and the first holder engagement portion 23 are engaged with each other, so that the first rear holder 4 is maintained in a mounting state.

An inclined surface 23*c* extending from the front end surface 23*a* to the back surface 23*b* of the holder engagement portion 23 in opposite to the bottom surface 32 of the insertion groove 30 is formed. The inclined surface 23*c* guides the engageable portion 44 to move to an engagement position with the first holder engagement portion 23.

In the same manner, in both corners of the rear portion of the back surface 27 in the housing body 2, insertion grooves corresponding to the concave portions extending in parallel to the terminal receiving chamber 21 from the rear end surface 25 of the housing body 2 are respectively formed, and the second holder engagement portion is projected in the wall surface of each of the insertion grooves disposed in opposite to the rear end surface 25. An inclined surface having the same structure as that of the first holder engagement portion 23 is formed in the front end portion of the second holder engagement portion.

In this case, since the structure mentioned above in the second rear holder 6 side is the same as the structure of the first rear holder 4 side, illustration thereof is omitted.

In the connector housing 1 described above, as shown in FIG. 6, when the first holder engagement portion 23 of the housing body 2 and the engageable portion 44 of the first rear holder 4 are engaged with each other, the holder engagement portion 23, the convex portion 43 of the first rear holder 4 and the engageable portion 44 projected in the convex portion 43 are received within the insertion groove 30 formed on the surface 26 of the housing body 2.

This fact can be applied to all the insertion grooves 30 formed on the surface 26 and the back surface 27 of the housing body 2. Accordingly, in the connector housing 1, the holder engagement portion 23 of the housing body 2, and the convex portions 43 and 63 and the engageable portions 44 and 64 of the first and second rear holders 4 and 6 are received within the insertion groove 30, thereby being protected from breakage. As a result, both the rear holders 4 and 6 can be securely prevented from floating from the housing body 2, so that a double engagement state of the connector terminal by both the rear holders 4 and 6 can be securely maintained.

Further, at a time of engaging the first holder engagement portion 23 with the engageable portion 44 (at a time of mounting the first rear holder 4 to the first mounting portion 22), the first rear holder 4 is pressed toward the holder body 2 against an biasing force of the first band 3, the convex portion 43 is inserted into the insertion groove 30, the first rear holder 4 is slid frontward, and the engageable portion 44 is moved toward the holder engagement portion 23. As shown in FIG. 6, the upper surface 46 of engageable portion 44 smoothly comes to the back surface 23*b* of the holder engagement portion 23 with being guided by the inclined surface 23*c* of the front end portion of the holder engagement portion 23, so that the back surface 23*b* of the holder engagement portion 23 and the first holder engagement portion 23 are engaged with each other by the biasing force of the band 3.

Since this fact can be applied to all the insertion grooves 30 formed on the surface 26 and the back surface 27 of the housing body 2, in the connector housing 1, the holder engagement portion 23 of the housing body 2, and the engageble portions 44 and 64 of the first and second rear holders 4 and 6 can be smoothly engaged with each other, so that both the rear holder 4 and 6 can be smoothly mounted to the housing body 2.

Figure 1:
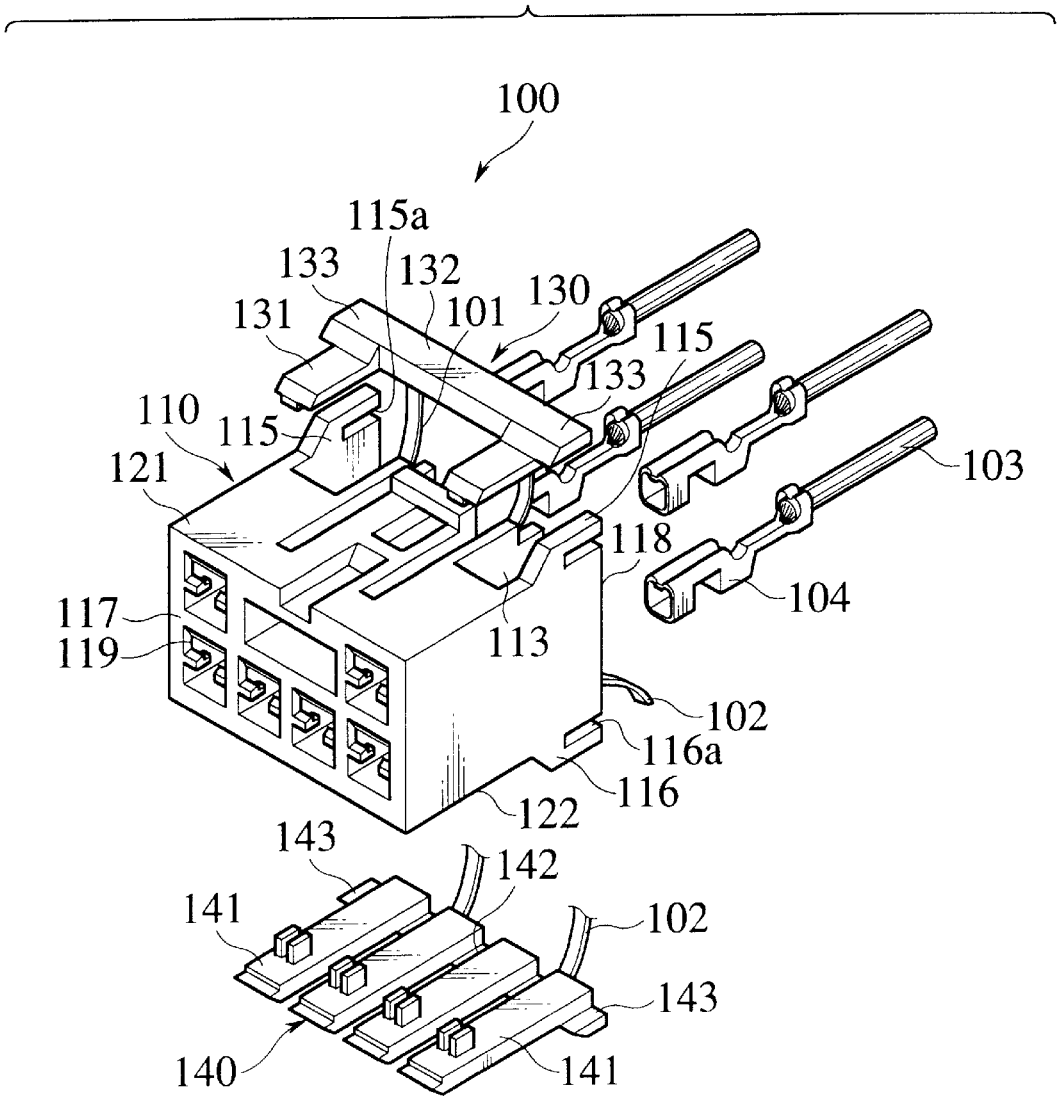
FIG.1 PRIOR ART
FIG. 1 is a perspective view which shows a conventional structure of a connector housing.
Figure 2:
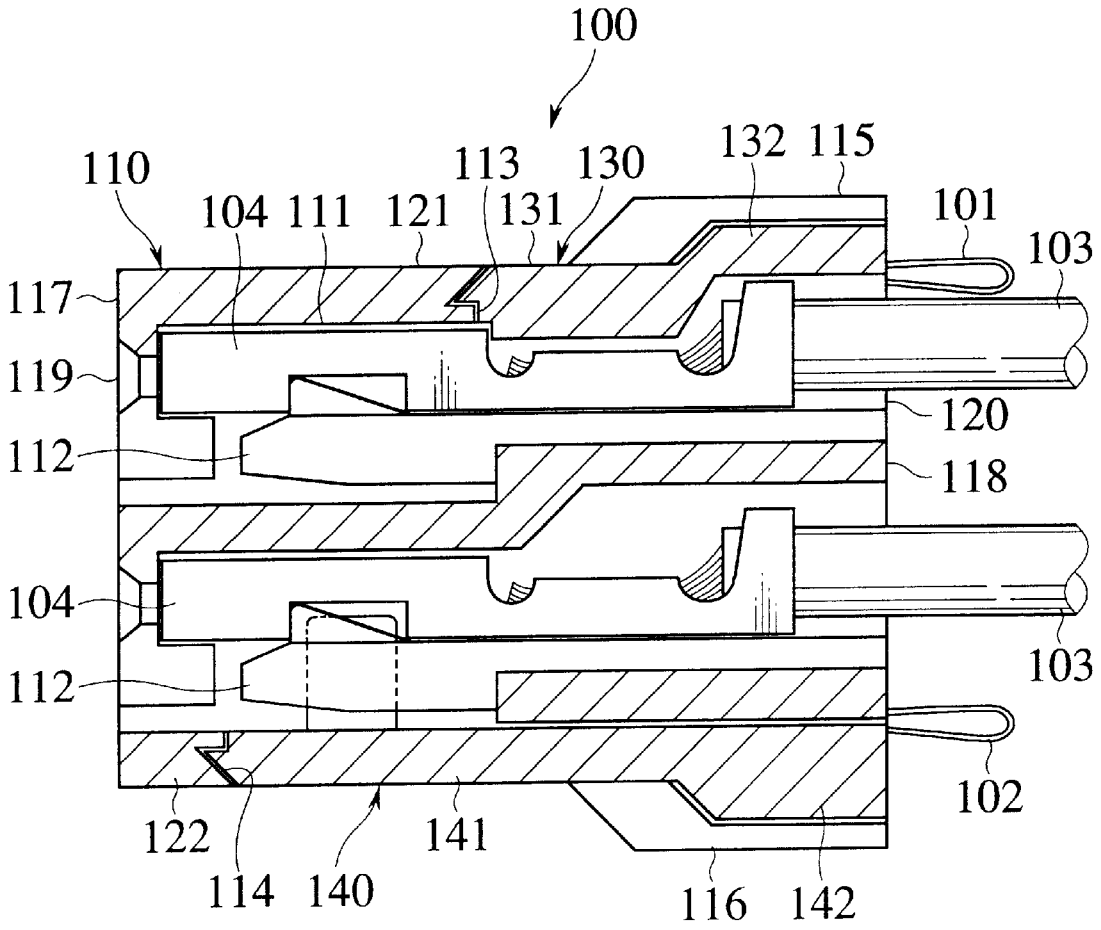
FIG.2 PRIOR ART
FIG. 2 is a vertical cross sectional view of the connector housing shown in FIG. 1 after assembling.

In this case, in the conventional connector housing 100 shown in FIGS. 1 and 2, it is necessary to strongly pull the rear holders 130 and 140 rearward in such a manner that the engageable portions 133 and 143 moves rearward from the rear end surface 118 of the housing body 110 at a time of engaging the engageable portions 133 and 143 with the holder engagement portions 115 and 116, thereby inserting the engageable portions 133 and 143 into the engagement grooves 115 and 116*a*. Accordingly, since the engageable portions 133 and 143 are inserted into the engagement grooves 115 and 116*a* in a state of strongly pulling the bands 101 and 102, it is hard to insert it, so that an engaging operation is difficult.

On the contrary, in the connector housing 1, as shown in FIGS. 3 and 4, at a time of engaging the engageable portions 44 and 64 of both the first and second rear holders 4 and 6 with the holder engagement portion 23 of the housing body 2, the rear holder 4 and 6 are pressed so as to bend and deform the bands 4 and 6, thereby inserting the insertion convex portions 43 and 63 of the rear holders 4 and 6 into the insertion groove 30 at a position in front of the rear end surface 25. Accordingly, it is unnecessary to pull the bands 3 and 5, so that the holder engagement portion 23 and the engageable portions 44 and 64 can be easily engaged.

What is claimed is:

1. A structure of a connector housing comprising:

a housing body having a terminal receiving chamber in which a connector terminal is received, a first terminal engagement portion engaging with the received terminal and a holder engagement portion; and a rear holder having an engageable portion and a second terminal engagement portion, the engageable portion engaging with the holder engagement portion and preventing the rear holder from floating from the holder body, the second terminal engagement portion engaging with the connector terminal which engages with the first terminal engagement portion as the holder engagement portion and the engageable portion are engaged with each other, wherein the holder engagement portion is disposed inside of a concave portion formed on an outer surface of the housing body, the rear holder has a convex portion inserted into the concave portion, and the engageable portion is disposed within a convex portion, and is positioned within the concave portion in a state of being engaged with the holder engagement portion.

2. A structure of a connector housing as recited in claim 1, wherein the holder engagement portion is projected within the concave portion, and the engageable portion is projected from the insertion convex portion of the rear holder.

3. A structure of a connector housing as recited in claim 2, wherein the concave portion is an insertion groove extending substantially in parallel to the terminal receiving chamber from a rear end surface of the housing body in which the connector terminal is inserted, and the holder engagement portion is projected on a wall surface of the insertion groove disposed in opposite to the rear end surface.

4. A structure of a connector housing as recited in claim 3, wherein the holder engagement portion includes an inclined surface provided between a front end surface of the holder engagement portion and a back surface of the holder engagement portion disposed in opposite to a bottom surface of the insertion groove, and the inclined surface guides the engageable portion to move to an engagement position with the holder engagement portion.

5. A structure of a connector housing as recited in claim 1, wherein the housing body and the rear holder are connected by a band having a flexibility.

6. A structure of a connector housing as recited in claim 3, wherein the housing body and the rear holder are connected by a band having a flexibility.

7. A structure of a connector housing as recited in claim 5, wherein the band keeps the engageable portion at a predetermined position above the holder engagement portion as that the holder engagement portion and the engageable portion are not engaged with each other, and the band biases the engageable portion to the predetermined position as the engageable portion moves from the predetermined position.

8. A structure of a connector housing as recited in claim 6, wherein the band extends toward the rear end surface from the outer surface of the housing body adjacent to the outer surface on which the insertion groove is formed, bends toward an upper direction of the insertion groove, and is continuously provided in the end portion opposite to the engageable portion of the rear holder, and the band keeps the engageable portion at a predetermined position above the holder engagement portion as the holder engagement portion and the engageable portion are not engaged with each other, and the band biases the engageable portion to the predetermined position as the engageable portion moves from the predetermined position.

9. A structure of a connector housing as recited in claim 1, wherein the engageable portion is spaced away from the second terminal engagement portion along a longitudinal direction of the rear holder.

10. A structure of a connector housing as recited in claim 1, wherein the convex portion extends away from a back surface of the holding member along a direction substantially transverse to a longitudinal direction of the rear holder.

11. A structure of a connector housing as recited in claims 1, wherein the concave portion comprises:

a bottom surface spaced inside of the outer surface of the housing body; and a wall surface extending from the outer surface of the housing body.

12. A structure of a connector housing as recited in claim 11, wherein the holder engagement portion of the housing body comprises:

a back surface spaced inside of the outer surface of the housing body and extending from the wall surface of the concave portion; and a front end surface extending from the top surface.

13. A structure of a connector housing as recited in claim 12, wherein the holder engagement portion of the housing body further comprises:

a inclined surface extending between the front surface and the back surface of the holder engagement portion.

14. A structure of a connector housing as recited in claim 12, wherein the engageable portion comprises:

a upper surface for engaging the back surface of the holder engagement portion when the engageable portion is positioned within the concave portion.

15. A structure of a connector housing as recited in claim 12, wherein the convex portion comprises:

an extension surface extending from the holding member for engaging the front end surface of the holder engagement portion when the engageable portion is positioned within the concave portion.

* * * * *